United States Patent [19]

Gilreath

[11] Patent Number: 4,573,821

[45] Date of Patent: Mar. 4, 1986

[54] WINDOW INDEX SYSTEM FOR RING BINDERS

[76] Inventor: Charles T. Gilreath, 217 NW. 34 Drive, Gainesville, Fla. 32607

[21] Appl. No.: 709,972

[22] Filed: Mar. 8, 1985

Related U.S. Application Data

[63] Continuation of Ser. No. 456,537, Jan. 7, 1983, abandoned.

[51] Int. Cl.[4] ..... B42D 13/00; B42D 11/04; B42D 21/00

[52] U.S. Cl. ..... 402/78; 402/80 L; 402/80 P; 402/503; 281/38; 283/42

[58] Field of Search ..... 281/31, DIG. 1; 283/38, 283/40, 42; 402/78, 80 R, 80 L, 80 P, 503, 3

[56] References Cited

U.S. PATENT DOCUMENTS

| | | | |
|---|---|---|---|
| 675,909 | 6/1901 | Shepherd | 283/38 |
| 970,399 | 9/1910 | Sawyer | 281/31 |
| 2,068,262 | 1/1937 | Brown | 129/1 |
| 2,693,370 | 11/1954 | Wheatley | 281/44 |
| 2,704,546 | 3/1955 | Slonneger | 129/1 |
| 2,784,757 | 3/1957 | Bosca | 150/38 |
| 3,092,400 | 6/1963 | Smith | 281/19 |
| 3,208,772 | 9/1965 | Dahlstrand et al. | 283/63 |
| 3,700,264 | 10/1972 | Friedman | 283/38 |
| 3,719,161 | 3/1973 | Wegner | 116/119 |
| 3,877,729 | 4/1975 | Friedman | 283/42 |
| 3,965,599 | 6/1976 | Ebner | 40/152 |
| 4,315,697 | 2/1982 | Horowitz | 402/79 |

FOREIGN PATENT DOCUMENTS

| | | | |
|---|---|---|---|
| 2141497 | 3/1973 | Fed. Rep. of Germany . | |
| 1052934 | 1/1954 | France | 283/42 |
| 6600433 | 7/1966 | Netherlands | 283/42 |
| 1101686 | 1/1968 | United Kingdom | 402/80 L |

*Primary Examiner*—Paul A. Bell
*Assistant Examiner*—Taylor J. Ross
*Attorney, Agent, or Firm*—Kerkam, Stowell, Kondracki & Clarke

[57] ABSTRACT

A ring binder-based filing system including enhanced prime storage areas for storing content or information records such as an index, table of contents, glossary, or the like. The two prime storage areas in a ring binder, the Home location inside the front cover and the End location inside the rear cover, are fully exploited by providing means for displaying and protecting the underlying information records while facilitating easy replacement or updating of information records, and by providing a means for rapid access to these prime locations. Two transparent windows are provided at each prime location, one hinged to the respective cover and retained by a magnetic latch system, and the other secured to the binder rings. A Homing Tab extends from an edge of the windows secured to the binder rings and facilitates return from any internal storage location back to either one of the prime locations.

14 Claims, 6 Drawing Figures

FIG. 1.
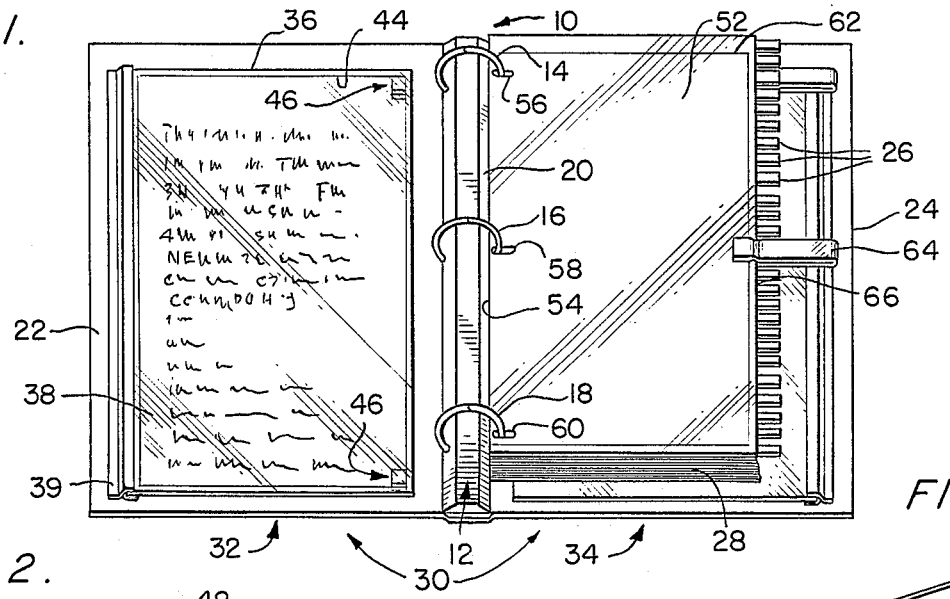
FIG. 3.
FIG. 2.
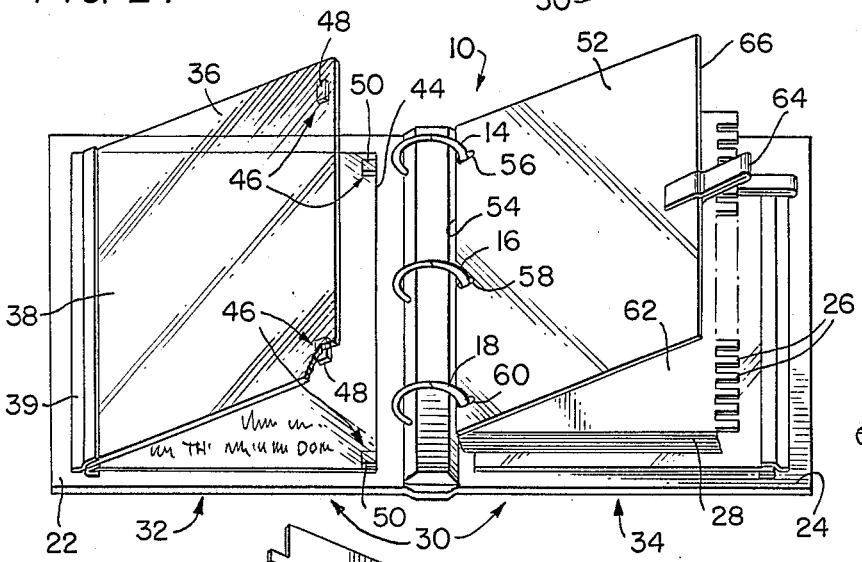
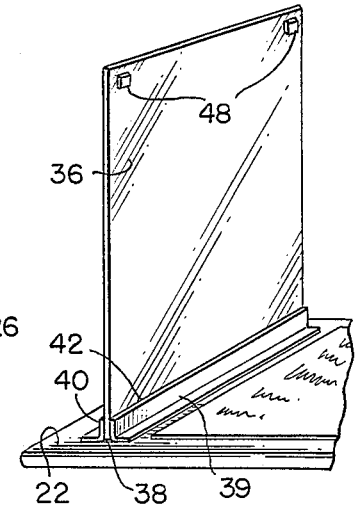
FIG. 4.
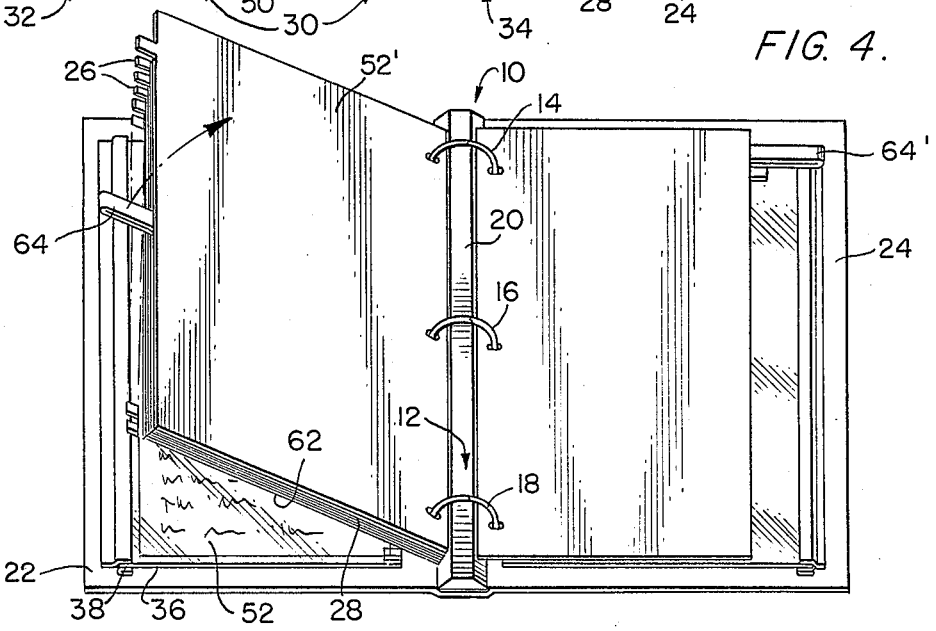

WINDOW INDEX SYSTEM FOR RING BINDERS

CROSS-REFERENCE TO RELATED APPLICATION

This is a continuation of copending application Ser. No. 456,537, filed Jan. 7, 1983, and now abandoned.

BACKGROUND OF THE INVENTION

The present invention relates generally to manual filing systems of the type employing ring binders and, more particularly, to ring binder-based filing systems including enhanced prime storage areas for storing content or information records such as an index, table of contents, glossary, or the like. While the invention is described herein in the context of a ring binder handling letter-sized (8½ by 11 inch) records, it will be appreciated that the principles of the invention are applicable to ring binders of other sizes, as well as to any book, however bound.

Ring binders have long been an important tool in the technology of manual filing systems. In any filing system, manual or computerized, speed of access is an important objective. Two problems in particular addressed by the present invention are the need to go quickly to the index of a file, and to then quickly access the indicated storage location, typically defined by a tabbed divider sheet.

One prime location in a ring binder (or any book) is the area viewed when the front cover has been opened. This one prime location is for convenience herein termed the "Home" or "$\phi$" location. The importance of the Home location stems from the fact that it is inherently the most accessible location in the binder. Typically, this prime location is employed to store content or information records. The term "information records" as employed herein is intended to mean, by way of example and not limitation, such records as an index, a table of contents, a glossary or any combination.

Corresponding to the prime storage area at the front of the binder is another prime storage area, inside the back cover. This other prime location is for convenience herein termed the "End" or "N" location, and may be viewed as the second most important location in a binder because its accessibility is surpassed only by the prime storage area at the front of the binder.

It is a common practice in various prior art proposals to utilize these two prime storage areas, but only in an incomplete and restricted way.

By way of example, in many prior art systems, the left side of the Home location ("$\phi$ Left") and the right side of the End location ("N Right") either have been ignored as surfaces for displaying information, or else have been relegated to the secondary task of holding miscellaneous papers in a carrying pocket. In short, prior art systems have failed to fully exploit the Home and End locations, commonly using less than 50% of the total capacity of these prime storage areas.

Moreover, it will be appreciated that, the greater the file capacity, the greater is the need for index space. By way of example, it may be desired to include on the order of twenty-five tabbed dividers defining individual storage locations, each containing a number of content sheets. This means data concerning at least twenty-five items must be covered within the available index space, in addition to any specialized information such as a glossary. Accordingly, it will be appreciated that there is a need to utilize all of the potential space in the prime locations.

By way of possible explanation for the reason that prior art systems have failed to fully exploit the Home and End locations, it is believed that the conventional sheet lifter is one reason. Sheet lifters are semi-rigid plates, usually smaller than the content sheets, and are found in conventional ring binders for the purpose of guiding the motion of the content sheets, particularly as the covers are closed. Because of their opaqueness, sheet lifters block out portions of any underlying information record at the home right location. Moreover, the action of the sheet lifter sliding across the inside covers tends to damage any information sheet or sheets placed inside the covers.

Another deficiency of prior art system lies in the degree of accessibility to a prime storage area from a storage location within the file. For example, to get from a remote location (for example, at tab No. 25) back to the Home location, in a typical prior art system the user must grasp the first content sheet in the file, and pull all left-hand sheets to the right. This action is usually somewhat awkward, and also tends to damage the first information record.

SUMMARY OF THE INVENTION

Accordingly, it is an object of the invention to provide a ring binder index system including expanded prime storage areas having enhanced accessability.

It is yet another object of the invention to provide such an index system which facilitates the frequent and important operation of returning to either the Home or the End location from any location within the file.

Briefly, and in accordance with an overall concept of the invention, the Home and End locations in files such as loose-leaf ring binder files are fully exploited by using both sides of both prime storage areas, by providing means to protect the underlying information records while facilitating easy replacement or updating of information records, and by providing a means for rapid access to the prime locations.

Briefly, and in accordance with a more particular aspect of the invention, two transparent windows are provided at at least one of the prime storage areas, and preferably at both. The windows provide not only full visual access, but easy physical access to the underlying information records.

Considering the Home location (the primary storage area within the front cover), hinged to the inside of the front cover is a transparent window sheet, which may be termed a "Home Left Window" or "$\phi$ Left Window". The hinged window sheet is preferably of clear plastic, and of sufficient thickness so as to be relatively stiff. The hinged window sheet is secured by a hinge along its outer (left) edge, and a magnetic latching system is provided generally at the inner edge. The magnetic latching system includes at least one element secured to the hinged transparent window sheet and at least one other element secured to the front cover in alignment with the one element for retaining the hinged transparent window sheet and the underlying information record sheet against the inside of the front cover. Thus, the Home Left window serves to hold, protect, and display a full-sized, underlying information record, and requires no special parts whatsoever to be attached to the information record.

The transparent window on the right side of the home location is the same size as the Home Left window, but is secured at the inner edge by the binding system, in the case of a notebook, the rings, just like all the other sheets in the binder. This particular window may be termed the Homing Window, and has the same functions as the Home Left Window i.e., the hold, protect, and display a full-sized underlying information record. The Homing Window further serves two important additional functions: First, the Homing Window serves as a sheet lifter, eliminating the use of the troublesome conventional sheet lifter. Second, the Homing Window serves an important "homing" function, accomplished by means of an extending tab, termed the "Homing Tab", at another edge of the Homing Window sheet. Preferably the Homing Tab is secured to the edge opposite the binder rings. The Homing Tab is employed by the user to facilitate return from any internal storage location back to the home location.

It will be appreciated that the net effect of the two windows, i.e. the Home Left Window and the Homing window, is full utilization of the important prime storage space. This space can be used to contain any information which is frequently needed or is especially important to the user.

Preferably, another prime storage area inside the rear cover of the binder is constructed in the same way, with a set of essentially identical elements, but oriented as in a mirror image with respect to the orientation of corresponding elements in the Home location.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

FIG. 1 is a view depicting a loose-leaf ring binder notebook in accordance with the invention opened to the Home location;

FIG. 2 shows both transparent windows at the Home location in a partially open position, providing physical access to underlying information records;

FIG. 3 is an enlarged view showing the structure of a suitable hinge for the Home Left window;

FIG. 4 depicts the manner in which the Homing Tab is utilized to quickly return to the Home location;

DETAILED DESCRIPTION OF THE PREFERRED EMBODIMENT

Figure 5:
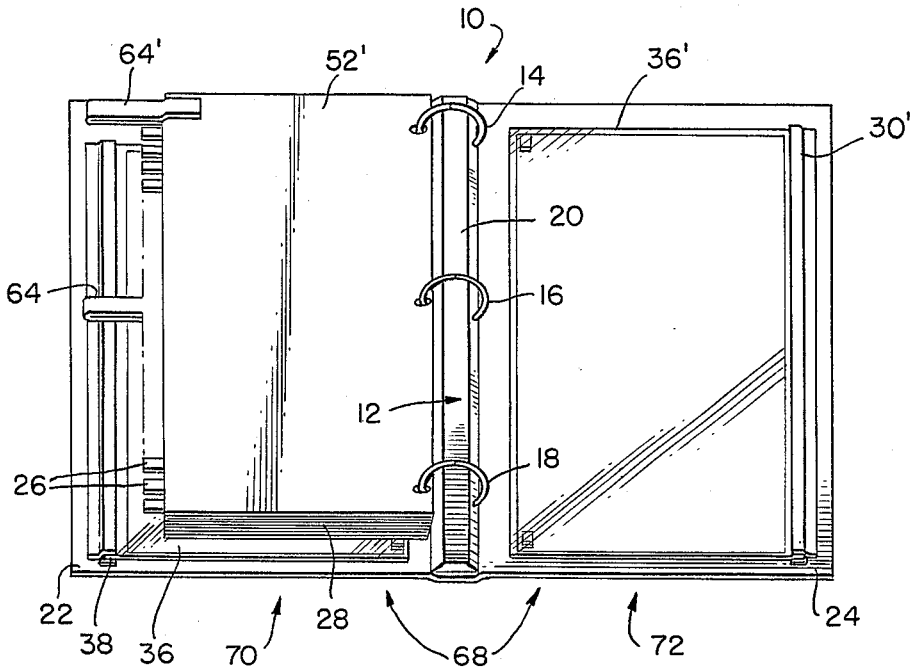
FIG. 5 is a view similar to FIG. 1, but showing the notebook open to the End location.
Figure 6:
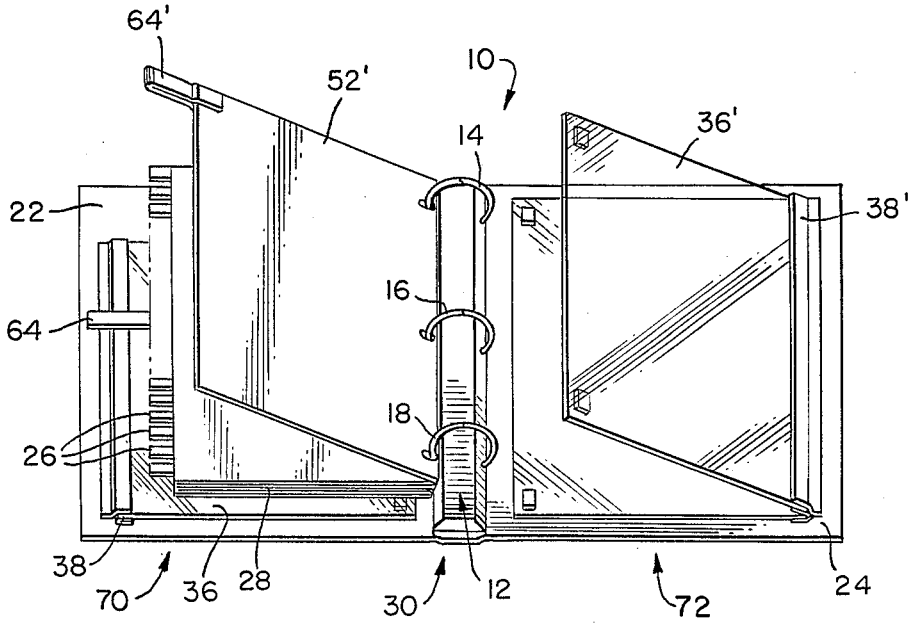
FIG. 6 is a view showing both transparent windows of the End location in a partially open position, providing physical access to underlyilng information records.

In its preferred form, the invention may be viewed as a conventional loose-leaf three-ring binder, suitably modified, and, for convenience, is so described hereinbelow. Although the invention is illustrated and described herein in the specific context of a ring binder handling letter-sized 8½ by 11 inch records, it will be appreciated that the principles of the invention are applicable to ring binders of other sizes and, in fact, to any book bound in any manner whatsoever.

Referring to drawing FIGS. 1–2 and 4–6, a basic loose-leaf notebook ring binder 10 includes a sheet-retaining spine 12 of conventional three-ring configuration. The spine 12 includes three rings 14, 16 and 18 each comprising a pair of ring halves, and operated by a conventional toggle joint carrier mechanism (not shown) within a housing 20. Front and rear covers 22 and 24 complete the structure of the basic notebook.

Within the notebook 10 are a plurality, e.g. twenty-five, of tabbed dividers 26, defining individual storage locations therebetween. Content sheets 28 are included in the storage locations defined by the tabbed dividers 26 to suit the requirements of the particular filing system.

With particular reference to FIGS. 1 and 2, in these views, the notebook 10 is opened to the Home location, which is the first location accessed when the front cover 22 is opened. In the views of FIGS. 1 and 2, all content sheets in the binder, including the tabbed dividers 26, are located to the right of the spine 12.

Visible in FIGS. 1 and 2 is what may be termed a prime storage area 30 including a left side 32 and a right side 34. In the case of the prime storage area 30 located within the front cover 22, as stated above the entire prime storage area 30 may be viewed as the "Home" location, the left side 32 may be viewed as the "Home Left" or "ϕ Left" location, and the right side 34 may be viewed as the "Home Right" or "ϕ Right" location.

The prime storage area 30 includes, on the left side 32, a transparent window sheet 36 hinged at its left edge 38 to the inside of the front cover 22 as may be best seen from FIG. 3. As also stated above, the sheet 36 may be termed the "Home Left" or "ϕ Left" window. As depicted in greater detail in FIG. 3, a suitable hinge 39 comprises, for purposes of example, two strips 40 and 42 of clear plastic tape, binding both sides of the window sheet 36 to the front cover 22. It will be appreciated that this particular form of hinge 39 is exemplary only, and that a variety of other means may be employed, for example, a hinge formed integrally with the transparent window sheet 36 itself.

The transparent window sheet 36 is of sufficient thickness so as to be relatively stiff. By way of example, the window sheet 36 may comprise clear acetate having an overall size of 8½ by 11 inches, and a thickness of 0.02 inches.

Underlying the window sheet 36 is a first information record sheet 44, which may be any desired form of index sheet, content sheet, or similar sheet, as described hereinabove, preferably providing index information for the content sheets 28 denoted by the tabbed dividers 26. In FIG. 1, the window sheet 36 is in the closed position, fully protecting the underlying information record sheet 44 while displaying, without substantial visual obstruction, the entire first information record sheet 44.

However, as depicted in FIG. 2, when necessary, physical access to the underlying record sheet 44 is facilitated by the hinge 39.

For retaining the transparent window sheet 36 in the closed position indicated in FIG. 1, a magnetic latch system, generally designated 46 is provided. The magnetic latch system 46 includes elements 48 secured to the underside of the hinged window sheet 36, and elements 50 secured to the front cover 22 in alignment with the elements 48. The corresponding elements 48 and 50 are preferably positioned generally at the corners of the window sheet 36 and arranged such that magnetic lines of force extending between the elements 48 and 50 pass through the underlying information record 44. Typically, the elements 48 and 50 are mounted approximately ¼ inch in from each of the edges meeting at a particular corner.

Suitable magnets are available in the form of strips of self-adhesive magnetic tape comprising a slightly-flexible plastic binder with embedded magnetic particles. Such a tape is available in a thickness of 0.06 inch and width of a 1.0 inch. Preferably, individual rectangular pieces are cut, with an overall size of 1.0 by 0.5 inches, and are positioned at the sheet 36 corners approximately ¼ inch from each adjoining edge.

Either all four elements 48 and 50 can comprise magnets, or one element of each pair can comprise a magnet, and the other merely a piece of magnetic material, such as ordinary iron or steel. In one form, the elements 50 may be embedded in or recessed into the front cover 22.

At the right hand side 34 of the Home location 30 is a transparent Homing Window sheet 52 secured at one edge 54 by the sheet retaining spine 12 as the first sheet immediately inside the front cover 22. The homing window sheet 52 is mounted, like all other sheets in the binder 10, to the rings 14, 16 and 18 by means of three apertures 56, 58 and 60. Preferably the apertures 56, 58 and 60 are elongated as in a conventional sheet lifter, to facilitate movement within the ring mechanism.

The Homing Window sheet 52 serves to protect and facilitate the view of a second information record sheet 62 also secured to the rings 14, 16 and 18 and underlying the transparent Homing Window sheet 52.

FIG. 1 shows the Homing Window 52 in its normally closed position, lying on top of all content sheets. It will be appreciated that its transparency enables full visual access to the underlying information record sheet 62.

FIG. 2 shows the Homing Window 52 partially opened. As in the case of the Home Left Window 36, the Home Window is generally opened only when physical access to the underlying record 62 is necessary. The Homing Window 52 is made of the same material as the Home Left Window 36. Thus Homing Window 52, by virtue of its durable, semi-rigid form, serves the same function as, and so eliminates the use of, a conventional sheet lifter.

To facilitate rapid return to the prime storage area 30, a homing tab 64 in the form of an extending tab is affixed to the outer edge 66 of the Homing Window sheet 52. In one form, the Homing Tab 64 comprises a strip of plastic transparent tape ½ inch wide, and extending out on the order of 1¼ inches. The tape is folded back onto itself into a double layer attached to opposite sides of the acetate Homing Window sheet 52. The flexibility of the tab 64 supports its function as a device for handling (grasping and pulling) the Homing Window 52.

With reference to FIG. 4, in use, to return to the Home location 30 (usually to consult the index), the user need merely to grasp and pull the Homing Window Tab 64, to close all sheets behind the current location (depicted in FIG. 4) and the Home location. This operation is easy and fast. The user need only touch the Homing Tab 64, minimizing wear on the information sheet 62 (FIGS. 1 and 2).

It will be appreciated that the Homing Tab 64 may be formed in a variety of ways, and may even be integrally formed with the Homing Window 52. Further, it will be appreciated that the size and location of the Homing Tab 64 may be altered.

With reference to FIG. 5, a second prime storage location, generally designated 68, is defined inside the rear cover 24. This second prime location 68 is termed the "End" or "N" location, and is in turn divided into "End Left" or "N Left" and "End Right" or "N Right" locations 70 and 72. Located at the End location are an End Right window 36' and an Ending Window 52', corresponding, respectively, to the Home Left window 36 and the Homing window 52 described hereinabove. It will be appreciated that, at the second prime storage location 68 inside the rear cover 24, essentially identical elements are employed, with the exception that the window 36' is hinged at the right (but still at the outer edge 30'). Preferably, also, the ending window tab 64' is located at a different point along the edge.

Thus, the Ending window 52' is identical to the Homing Window 52 in all respects, except for the location of the tab 64'. The counterpart to the Home Left window 36 is the End Right window 36'. The same type of important information placed in the Home location 30 can be placed in the End location 68.

In view of the foregoing, it will be appreciated that the present invention provides a means for full utilization of the important space in the home and end locations of an indexing system comprising a binder. In addition, the Homing and Ending windows 36 and 36' provide a means to rapidly access these important locations. The total effect of these components is enhanced accessibility to the information stored in the file.

While a specific embodiment of the invention has been illustrated and described herein, it is realized that numerous modifications will occur to those skilled in the art. It is therefore to be understood that the appended claims are intended to cover all such modifications and changes as fall within the true spirit and scope of the invention.

What is claimed is:

1. A loose-leaf ring binder comprising:

a spine including a plurality of rings for retaining sheets;

a front cover;

a rear cover; and at least one prime storage area including:

a transparent window sheet hinged at one edge to the inside of at least one of said covers for protecting and facilitating view of a first underlying information record sheet, a magnetic latch system including at least one element carried by said hinged transparent window sheet and at least one other element carried by said one of said covers in alignment with said one element for retaining said hinged transparent window sheet and the underlying information record sheet against the inside of said one of said covers, and a transparent homing window sheet secured at one edge by said sheet-retaining spine as the first sheet immediately inside said one of said covers for protecting and facilitating view of another information record sheet also secured by said sheet-retaining spine and underlying said transparent homing window, said homing window sheet having sufficient rigidity to serve as a sheet lifter.

2. A ring binder in accordance with claim 1, wherein said transparent homing window sheet includes an extending tab at another edge of said homing sheet to facilitate return to said prime storage area from any location within said ring binder.

3. A ring binder in accordance with claim 1, wherein said one prime storage area is located inside said front cover; and which further comprises:

a second prime storage area including:

another transparent window sheet hinged at one edge to the inside of said rear cover for protecting and facilitating view of a third underlying information record sheet;

another magnetic latch system including at least one element carried by said other hinged transparent window sheet and at least one other element carried by said rear cover in alignment with said one element for retaining said other hinged transparent window sheet and the underlying third information record sheet against the inside of said rear cover; and a transparent ending window sheet secured at one edge by said sheet-retaining spine as the first sheet immediately inside said rear cover for protecting and facilitating view of a fourth information record sheet also secured by said sheet-retaining spine and underlying said transparent ending window sheet, said ending window sheet having sufficient rigidity to serve as a sheet lifter.

4. A ring binder in accordance with claim 3, wherein said transparent homing window sheet and said transparent ending window sheet each include an extending tab at another edge of the respective homing or ending sheet to facilitate return to either of said prime storage areas from any location within said ring binder.

5. A ring binder in accordance with claim 3, which further comprises a plurality of tabbed dividers defining individual storage locations.

6. A ring binder in accordance with claim 5, wherein said transparent homing window sheet and said transparent ending window sheet each include an extending tab at another edge of the respective homing or ending sheet to facilitate return to either of said prime storage areas from any location within said ring binder.

7. A window system in combination with a loose-leaf ring binder of the type including a spine having a plurality of rings for retaining sheets, a front cover, and a rear cover, said window system comprising:

a transparent window sheet hinged at one edge to the inside of at least one of the covers for protecting and facilitating view of an underlying information record sheet;

a magnetic latch system including at least one element carried by said hinged transparent window sheet and at least one other element carried by said one of the covers in alignment with said one element for retaining said transparent window sheet and the underlying information record sheet against the inside of said one of the covers; and a transparent homing window sheet secured at one edge by the sheet retaining rings as the first sheet immediately inside said one of the covers for protecting and facilitating view of another information record sheet also secured by the sheet-retaining rings and underlying said transparent homing window sheet, said homing window sheet having sufficient rigidity to serve as a sheet lifter, and said transparent hinged window sheet and said transparent homing window sheet together defining a prime storage area.

8. A window system in accordance with claim 7, wherein said transparent homing window sheet includes an extending tab at another edge of said homing sheet to facilitate return to said transparent homing window sheet from any location within the ring binder.

9. A window system in combination with a book of the ring binder type including a sheet-retaining spine, a front cover, and a rear cover, said window system comprising:

a first transparent window sheet hinged at one edge to the inside of said front cover for protecting and facilitating view of a first underlying information record sheet;

a magnetic latch system including at least one element carried by said first hinged transparent window sheet and at least one other element carried by said front cover in alignment with said one element for retaining said transparent window sheet and the first underlying information record sheet against the inside of said front cover;

a second transparent window sheet hinged at one edge to the inside of said rear cover for protecting and facilitating view of a second underlying information record sheet;

another magnetic latch system including at least one element carried by said second hinged transparent window sheet and at least one other element carried by said rear cover in alignment with said one element for retaining said second transparent window sheet and the underlying second information record sheet against the inside of said rear cover;

a transparent homing window sheet secured at one edge by the sheet-retaining spine as the first sheet immediately inside the front cover for protecting and facilitating view of a third information record sheet also secured by the sheet-retaining spine and underlying said transparent homing window sheet, said first transparent hinged window sheet and said first transparent homing window sheet together defining a first prime storage area; and a transparent ending window sheet secured at one edge by the sheet-retaining spine as the first sheet immediately inside the rear cover for protecting and facilitating view of a fourth information record sheet also secured by the sheet-retaining spine underlying said transparent ending window sheet, said second hinged transparent window sheet and said transparent ending window sheet together defining a second prime storage area.

10. A window system in accordance with claim 9, wherein said transparent homing window sheet and said transparent ending window sheet include respective extending tabs at other edges of said sheets to facilitate return to either said homing window sheet or said ending window sheet from any location within the ring binder.

11. A window system in combination with a loose-leaf ring binder of the type including a spine having a plurality of rings for retaining sheets, a front cover, and a rear cover, said window system comprising:

a transparent homing window sheet having elongated apertures at one edge in engagement with the sheet-retaining rings as the first sheet immediately inside one of the covers for protecting and facilitating view of an information record sheet also secured by the sheet-retaining rings and underlying said transparent homing window sheet, said homing window sheet having sufficient rigidity to serve as a sheet lifter; and an extending tab at another edge of said homing sheet to facilitate return to said transparent homing window sheet from any location within the ring binder.

12. A window system in accordance with claim 11, wherein:

said transparent homing window sheet is secured immediately inside the front cover; and which further comprises:

a transparent ending window sheet having elongated apertures at one edge in engagement with the sheet-retaining rings as the first sheet immediately inside the rear cover for protecting and facilitating view of another information record sheet also secured by the sheet-retaining rings and underlying said transparent ending window sheet, said ending window sheet having sufficient rigidity to serve as a sheet lifter; and an extending tab at another edge of said ending sheet to facilitate return to said transparent ending window sheet from any location within the ring binder.

13. A loose-leaf ring binder comprising:

a spine including a plurality of rings for retaining sheets;

a front cover;

a rear cover; and at least one prime storage area including:

a transparent window sheet hinged at one edge to the inside of at least one of said covers for protecting and facilitating view of a first underlying information record sheet, a latch system including at least one element carried by said hinged transparent window sheet and at least one other element carried by one of said covers in alignment with said one element for retaining said hinged transparent window sheet and the underlying information record sheet against the inside of said one of said covers, and a transparent homing window sheet secured at one edge by said sheet-retaining rings as the first sheet immediately inside said one of said covers for protecting and facilitating view of another information record sheet also secured by said sheet-retaining rings and underlying said transparent homing window, said homing window sheet having sufficient rigidity to serve as a sheet lifter.

14. A ring binder in accordance with claim 13, wherein said transparent homing window sheet includes an extending tab at another edge of said homing sheet to facilitate return to said prime storage area from any location within said ring binder.

* * * * *